US011079171B2

(12) United States Patent
Marinello et al.

(10) Patent No.: US 11,079,171 B2
(45) Date of Patent: Aug. 3, 2021

(54) REFRIGERATOR WITH SURROUND ILLUMINATION FEATURE

(71) Applicant: WHIRLPOOL CORPORATION, Benton Harbor, MI (US)

(72) Inventors: Giulia Marinello, Park Ridge, IL (US); Alberto R. Gomes, St. Joseph, MI (US); Lynne F. Hunter, Dorr, MI (US); Julia B. Burke, Chicago, IL (US); Daniel Chow, St. Joseph, MI (US); Abhay Naik, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 345 days.

(21) Appl. No.: 16/309,359

(22) PCT Filed: Oct. 26, 2016

(86) PCT No.: PCT/US2016/058803

§ 371 (c)(1),
(2) Date: Dec. 12, 2018

(87) PCT Pub. No.: WO2018/080472

PCT Pub. Date: May 3, 2018

(65) Prior Publication Data

US 2019/0310011 A1 Oct. 10, 2019

(51) Int. Cl.
*F25D 27/00* (2006.01)
*F25D 23/06* (2006.01)
(Continued)

(52) U.S. Cl.
CPC ..... *F25D 27/00* (2013.01); *F25D 23/066* (2013.01); *F25D 23/085* (2013.01);
(Continued)

(58) Field of Classification Search
CPC ..... F25D 27/00; F25D 23/066; F25D 23/085; F25D 11/02; F25D 2323/021; F25D 2400/40; F25D 2400/18; F21W 2131/305
See application file for complete search history.

(56) References Cited

U.S. PATENT DOCUMENTS 2,995,649 A * 8/1961 Cyrus ..... F25D 27/00 362/92
3,027,732 A * 4/1962 Mann ..... F25D 17/065 62/187

(Continued)

FOREIGN PATENT DOCUMENTS

DE 102009027890 A1 1/2011
EP 1180654 A1 2/2002

(Continued)

*Primary Examiner* — Hanh V Tran
(74) *Attorney, Agent, or Firm* — Price Heneveld LLP

(57) ABSTRACT

A refrigerator includes a vacuum insulated cabinet and a surround lighting feature. The vacuum insulated cabinet includes a liner disposed within a wrapper, which are interconnected by a thermal bridge to form a vacuum cavity therebetween. A wall covering assembly includes a top wall disposed adjacent to and spaced-apart from a top wall of the liner. The wall covering assembly also includes a rear wall disposed adjacent to and spaced-apart from a rear wall of the liner. In assembly, the liner and the wall covering assembly cooperate to define a refrigerator compartment. A cavity is formed between liner and the wall covering assembly. A surround lighting assembly is disposed around an opening into the refrigerator compartment and is powered by a wiring system concealed by the wall covering assembly.

16 Claims, 9 Drawing Sheets

(51) Int. Cl.
*F25D 23/08* (2006.01)
*F21W 131/305* (2006.01)
*F25D 11/02* (2006.01)

(52) U.S. Cl.
CPC ..... *F21W 2131/305* (2013.01); *F25D 11/02* (2013.01); *F25D 2323/021* (2013.01); *F25D 2400/40* (2013.01)

(56) References Cited

U.S. PATENT DOCUMENTS 3,288,896 A 11/1966 Hendricks
3,506,325 A 4/1970 Horvay
3,971,605 A 7/1976 Sasnett
4,671,074 A 6/1987 Gostelow et al.
4,714,304 A * 12/1987 Sisk ..... F25D 23/062 29/897.3
4,732,432 A * 3/1988 Keil ..... F25D 23/082 220/592.06
5,100,213 A 3/1992 Vandarakis et al.
5,219,103 A 6/1993 Carper
5,720,185 A 2/1998 Lee
5,722,252 A 3/1998 Kang et al.
5,884,496 A 3/1999 Kim et al.
5,980,058 A 11/1999 Guess et al.
5,996,370 A 12/1999 Lee
6,065,821 A 5/2000 Anderson et al.
6,073,458 A 6/2000 Kim
6,612,116 B2 9/2003 Fu et al.
6,698,222 B2 3/2004 Sanna et al.
6,813,896 B1 11/2004 Janke et al.
6,877,825 B2 4/2005 Khosropour et al.
7,093,453 B2 8/2006 Asan et al.
7,260,438 B2 8/2007 Caldwell et al.
7,338,180 B2 3/2008 Wing
7,343,757 B2 3/2008 Egan et al.
7,905,614 B2 * 3/2011 Aoki ..... F25D 27/00 362/92
8,690,274 B2 * 4/2014 Grutzke ..... F25D 23/066 312/406
9,671,158 B1 * 6/2017 Sandberg ..... F25D 27/00
10,139,150 B2 * 11/2018 de Cavalcanti ..... F25D 17/042
10,371,438 B2 * 8/2019 Ammerman ..... F21V 33/0044
10,830,384 B2 * 11/2020 Allard ..... F16L 59/065
10,830,526 B2 * 11/2020 Gomes ..... F25D 23/06
10,830,527 B2 * 11/2020 Deka ..... F25D 23/066
2002/0021062 A1 * 2/2002 Hodges ..... F25D 23/085 312/401
2003/0167787 A1 * 9/2003 Ohashi ..... F25D 17/065 62/443
2004/0104654 A1 * 6/2004 Lee ..... F25D 23/10 312/401
2004/0163408 A1 * 8/2004 Kim ..... F25D 23/003 62/428
2006/0196217 A1 9/2006 Duarte et al.
2006/0201181 A1 * 9/2006 Bauer ..... F21V 33/0044 62/264
2007/0074527 A1 4/2007 Lee et al.
2008/0110198 A1 5/2008 Egan et al.
2008/0115522 A1 5/2008 Kim et al.
2008/0164224 A1 7/2008 McCoy et al.
2008/0164796 A1 7/2008 McCoy et al.
2008/0165282 A1 7/2008 Marcy et al.
2008/0165474 A1 7/2008 McCoy et al.
2008/0165509 A1 7/2008 Kendall et al.
2008/0165998 A1 7/2008 LeClear et al.
2008/0166895 A1 7/2008 McCoy et al.
2008/0166915 A1 7/2008 Kendall et al.
2008/0245788 A1 * 10/2008 Choong ..... F25D 17/042 219/758
2009/0308094 A1 * 12/2009 Gorz ..... F25D 23/069 62/264
2011/0179817 A1 * 7/2011 Andersson ..... F25D 19/00 62/288
2012/0104923 A1 * 5/2012 Jung ..... F25D 23/066 312/406
2012/0297810 A1 * 11/2012 Resch ..... F25D 21/14 62/275
2012/0312798 A1 * 12/2012 Aoki ..... F25D 27/00 219/220
2013/0027906 A1 * 1/2013 Ueda ..... F25D 27/00 362/92
2014/0097735 A1 * 4/2014 De Bona ..... F25D 23/08 312/406.1
2015/0247634 A1 * 9/2015 Becke ..... F25D 27/00 362/555
2016/0010845 A1 * 1/2016 Brown ..... F25D 27/00 362/551
2016/0033194 A1 * 2/2016 Sumihiro ..... F25D 11/00 62/125
2020/0309443 A1 * 10/2020 Marinello ..... F25D 17/08

FOREIGN PATENT DOCUMENTS

EP 2543945 A1 9/2013
JP 05060459 9/1993
RU 2431790 C1 10/2011
RU 2509270 C2 10/2014
WO 2008026137 A2 3/2008
WO 2013170304 A1 11/2013

* cited by examiner

REFRIGERATOR WITH SURROUND ILLUMINATION FEATURE

BACKGROUND

The present device generally relates to insulated structures, and in particular, to a vacuum insulated cabinet structure that includes a surround illumination feature for illuminating a compartment thereof.

Various types of insulated refrigerator cabinets have been developed. The ability to illuminate a refrigerator or freezer cabinet is difficult when dealing with a vacuum insulated structure, as there are no wire guides or apertures in the vacuum insulated structure through which electrical components of a lighting feature can pass. Particularly, when dealing with a refrigerator that includes a vacuum insulated compartment, a metal liner is generally used. Access apertures and guides are generally not found in such a liner, as the cabinet structure will no longer have the ability to hold a certain vacuum level inside the cabinet. Thus, a solution for a modular and aesthetically pleasing lighting feature that adequately illuminates a refrigerator compartment is desired.

SUMMARY

One aspect of the present concept includes a refrigerator having a vacuum insulated cabinet. The vacuum insulated cabinet includes a liner disposed within a wrapper. The liner and wrapper are interconnected by a thermal bridge to form a vacuum cavity therebetween. A wall covering assembly includes a top wall disposed adjacent to and spaced-apart from a top wall of the liner. The wall covering assembly also includes a rear wall disposed adjacent to and spaced-apart from a rear wall of the liner. In assembly, the liner and the wall covering assembly cooperate to define a refrigerator compartment. A cavity is formed between liner and the wall covering assembly. A lighting assembly is disposed around an opening into the refrigerator compartment and is powered by a wiring system concealed by the wall covering assembly.

Another aspect of the present concept includes a refrigerator having a refrigerator liner with a front edge defining an opening into a refrigerator compartment. A thermal bridge includes a coupling portion coupled to the front edge of the refrigerator liner. An upwardly opening channel is disposed between the refrigerator liner and the thermal bridge. A lighting assembly is received in the upwardly opening channel, and is substantially disposed around an entirety of the opening into the refrigerator compartment for illuminating the same.

Yet another aspect of the present concept includes a refrigerator having a refrigerator liner with a quadrilateral front edge and an outer surface. A thermal bridge includes an outer surface and a coupling portion coupled to the front edge of the refrigerator liner. A gap is formed between the outer surface of the refrigerator liner and the outer surface of the thermal bridge. A lighting assembly is received in the gap, and is substantially disposed around an opening into a refrigerator compartment defined by the refrigerator liner.

These and other features, advantages, and objects of the present device will be further understood and appreciated by those skilled in the art upon studying the following specification, claims, and appended drawings.

DETAILED DESCRIPTION OF EMBODIMENTS

Figure 1A:
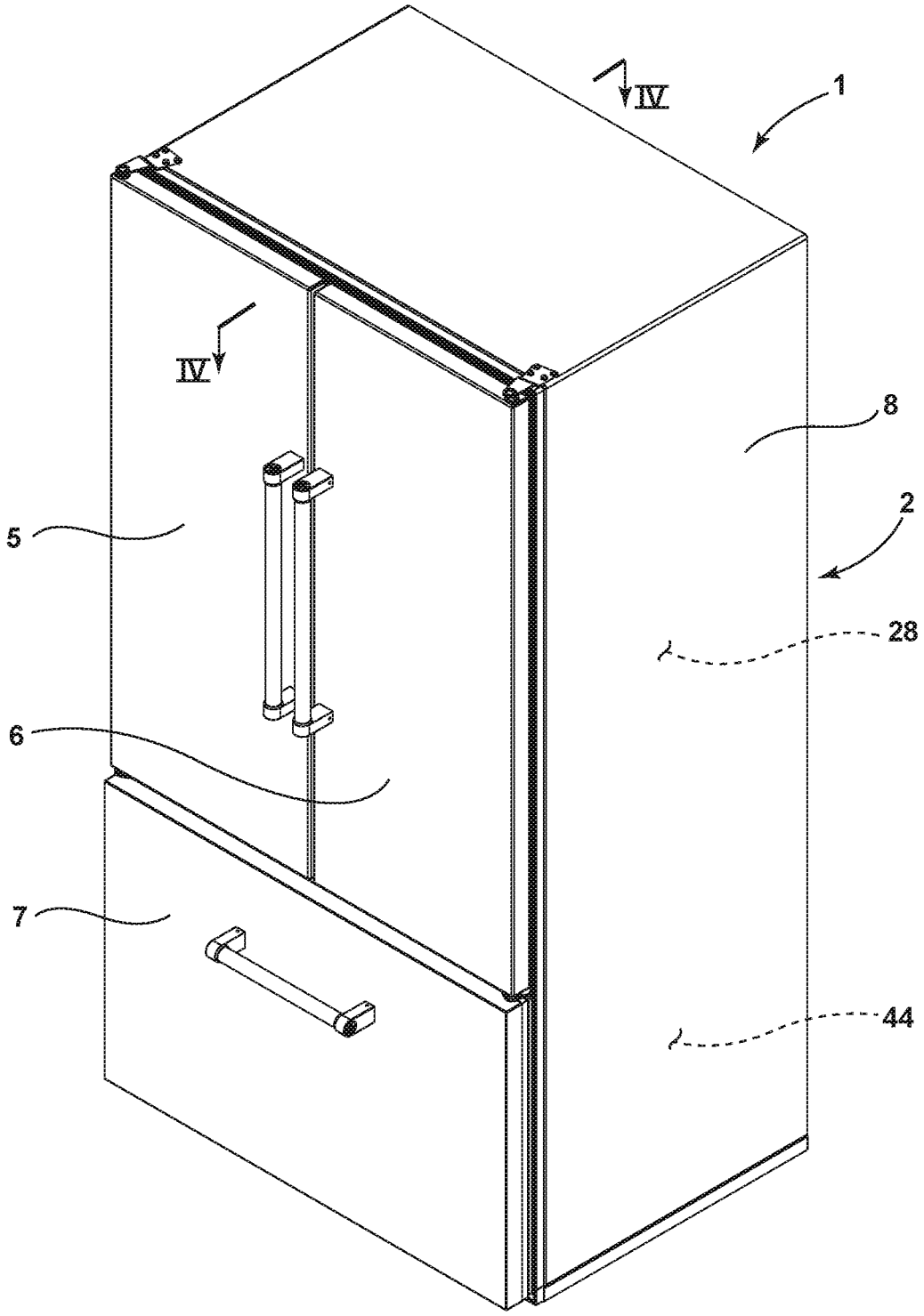
FIG. 1A is an isometric view of a refrigerator including a vacuum insulated cabinet structure.

For purposes of description herein the terms "upper," "lower," "right," "left," "rear," "front," "vertical," "horizontal," and derivatives thereof shall relate to the device as oriented in FIG. 1A. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1A, a refrigerator 1 includes a vacuum insulated cabinet structure 2 which further includes a refrigerator compartment 28 and a freezer compartment 44. Doors 5 and 6 are operable between open and closed positions to selectively provide access to the refrigerator compartment 28, while a drawer 7 is used to selectively provide access to the freezer compartment 44. The vacuum insulated cabinet structure 2 is surrounded by an exterior wrapper 8. The configuration of the refrigerator 1 is exemplary only and the present concept is contemplated for use in all refrigerator styles including, but not limited to, side-by-side refrigerators, whole refrigerator and freezers, and refrigerators with upper freezer compartments.

Figure 1B:
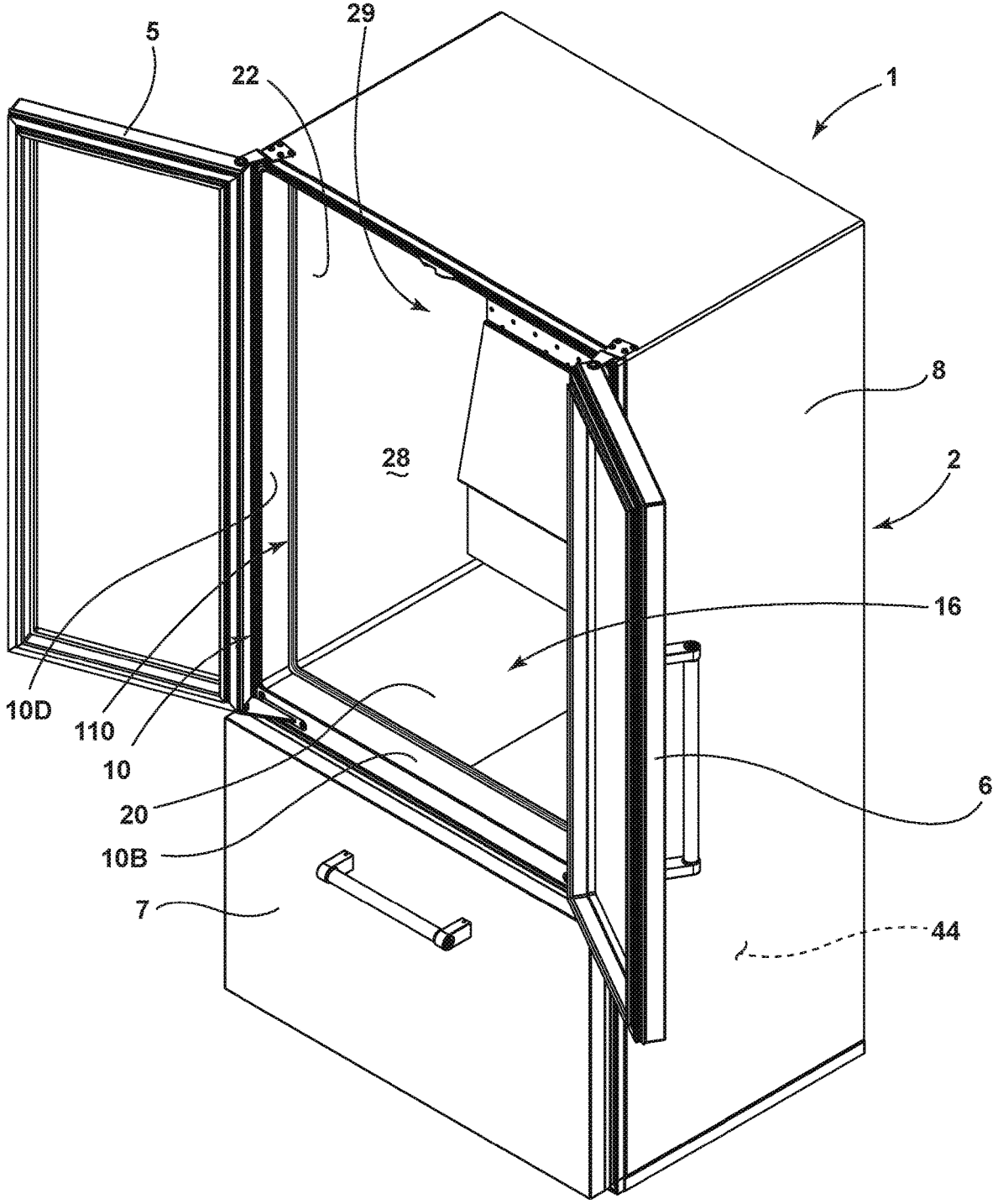
FIG. 1B is an isometric view of the refrigerator of FIG. 1A with the doors in an open position to reveal a refrigerator compartment.

Referring now to FIG. 1B, doors 5 and 6 are shown in an open position to reveal the interior of the refrigerator compartment 28. It is contemplated that the refrigerator compartment 28 may include any number of shelves or drawers disposed therein for storing various food items within the refrigerator compartment 28. As further shown in FIG. 1B, a wall covering assembly 29 is shown disposed within the refrigerator compartment 28 at a rear portion thereof. Further, a surround lighting feature 110 is shown disposed within a front portion of the refrigerator cabinet 28 between a sidewall 22 and bottom wall 20 of a refrigerator liner 16 and associated portion 10D, 10E of a thermal bridge 10. The surround lighting feature 110 is a lighting assembly contemplated to be disposed fully or partially around the opening of the refrigerator compartment 28 between the refrigerator liner 16 and the thermal bridge 10 for illuminating the refrigerator compartment 28 when one or both of the doors 5, 6 are in the open position as shown in FIG. 1B. The surround lighting feature 110 is contemplated to be a light guide assembly which propagates light throughout the entirety of the light guide assembly as disposed in a surround configuration around the refrigerator compartment 28 to illuminate the refrigerator compartment. The surround lighting feature 110 is a light assembly disposed in a surround configuration and is contemplated to be a flexible assembly as further described below.

Figure 2:
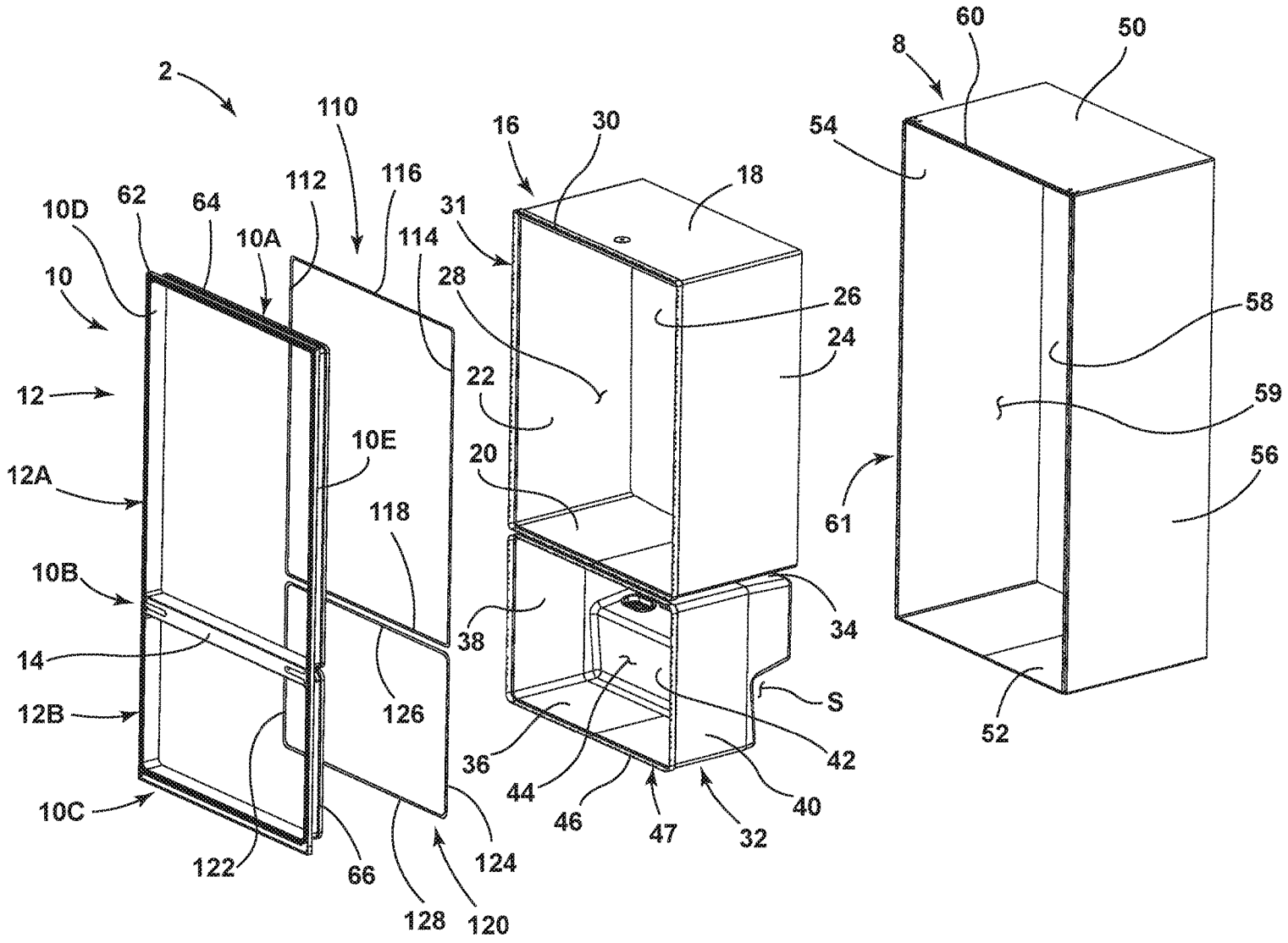
FIG. 2 is an exploded isometric view of a vacuum insulated cabinet structure.
Figure 4:
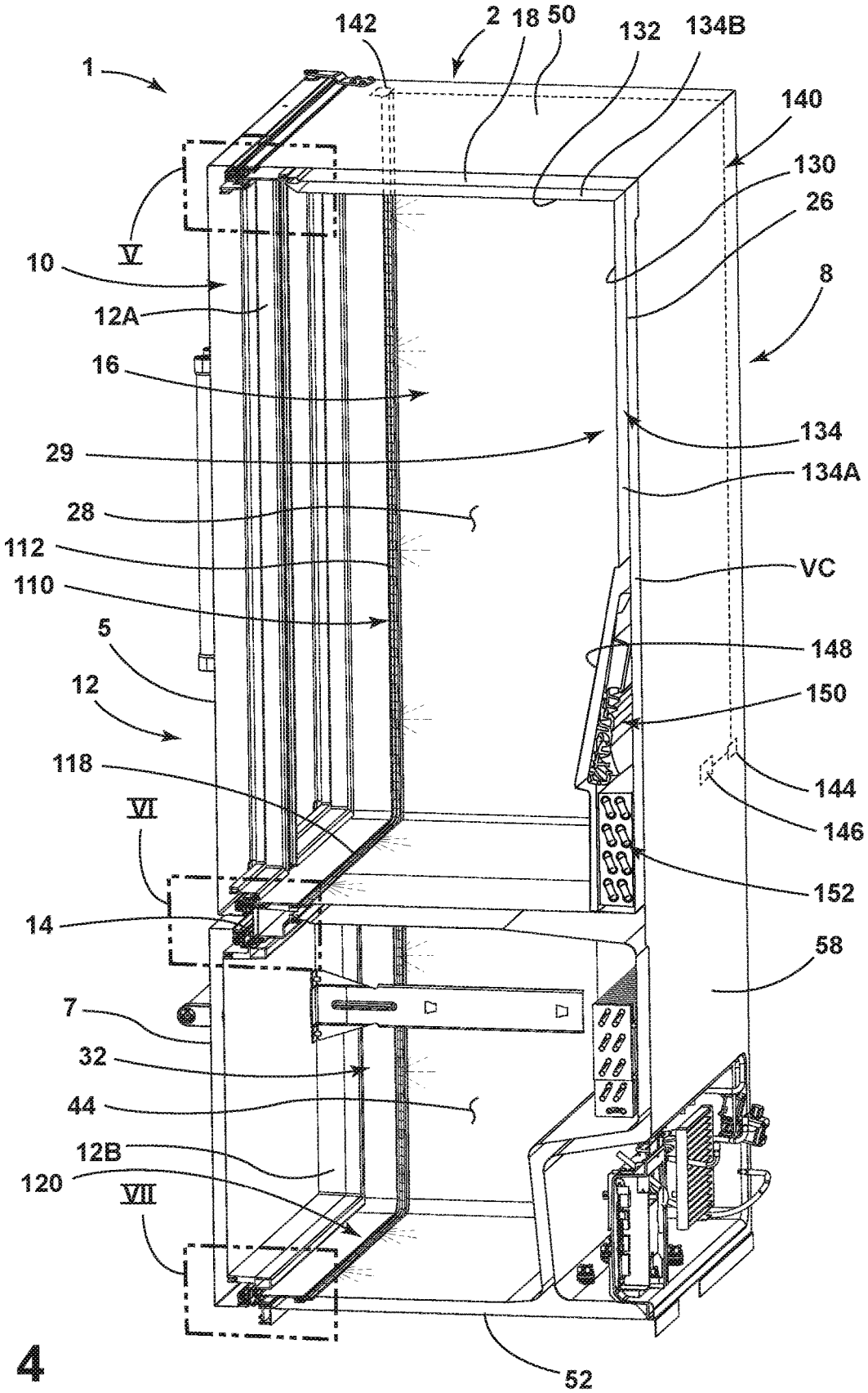
FIG. 4 is a cross-sectional view of the vacuum insulated cabinet structure of FIG. 1A taken at line IV.

Referring now to FIG. 2, the vacuum insulated cabinet structure 2 generally includes a thermal bridge 10 that includes a frame 12 having an upper opening 12A and a lower opening 12B with a mullion portion 14 disposed therebetween. The thermal bridge 10 includes an upper portion 10A, a middle portion 10B, a lower portion 10C and sidewalls 10D and 10E. The vacuum insulated cabinet structure 2 further includes a refrigerator liner 16 having a top wall 18, bottom wall 20, opposed sidewalls 22, 24, and a rear wall 26 which cooperate to define the refrigerator compartment 28. The refrigerator liner 16 further includes a front edge 30 disposed on a front portion of the refrigerator compartment 28 along the top wall 18, bottom wall 20 and opposed sidewalls 22, 24 in a quadrilateral ring configuration. Similarly, a freezer liner 32 includes a top wall 34, a bottom wall 36, opposed sidewalls 38, 40, and a rear wall 42 which all cooperate to define a freezer compartment 44. The rear wall 42 of the freezer liner 32 is a contoured rear wall that provides a spacing S for housing cooling components for cooling and freezer compartment 44. Cooling components for the refrigerator compartment 28 are housed behind the wall covering assembly 29 as shown in FIG. 4. Such cooling components may include a compressor, a condenser, an expansion valve, an evaporator, a plurality of conduits, and other related components used for cooling the refrigerator and freezer compartments 28, 44. The freezer liner 32 further includes a front edge 46 disposed at a front portion of the freezer compartment 44 which is disposed along the top wall 34, bottom wall 36 and opposed sidewalls 38, 40 in a quadrilateral ring configuration. In assembly, the front edge 30 of the refrigerator liner 16 and the front edge 46 of the freezer liner 32 define first and second openings 31, 47 that are configured to couple with coupling portions disposed about the upper and lower openings 12A, 12B of the thermal bridge 10, as further described below.

As further shown in FIG. 2, the surround lighting feature 110 is shown having first and second side portions 112, 114 and upper and lower portions 116, 118. The surround lighting feature 110 is coupled between the refrigerator liner 16 and the upper opening 12A of the thermal bridge 10 in assembly as shown in FIG. 1B. The present concept may also include a surround lighting feature 120 which is configured to be disposed within the freezer compartment 44. The surround lighting feature 120 includes first and second side portions 122, 124 and upper and lower portions 126, 128. In assembly, the lighting feature 120 is coupled between the freezer liner 32 and the lower opening 12B of the thermal bridge 10. Both the surround lighting features 110, 120 are quadrilateral lighting features configured to be disposed in a surround configuration within the refrigerator compartment 28 and freezer compartment 44, respectively. It is contemplated that a refrigerator of the present concept may include a surround lighting feature in both the refrigerator compartment 28 and the freezer compartment 44, or in the freezer compartment 44 alone, or the refrigerator compartment 28 alone. The surround lighting feature 110 is configured to follow the perimeters defined by the refrigerator compartment 28 along the front edge 30 thereof. Similarly, the surround lighting feature 110 follows the perimeters of the upper inner coupling portion 64 of the thermal bridge 10 for proper positioning of the surround lighting feature 110 within the refrigerator compartment 28 as shown in FIG. 1B. The surround lighting feature 120 is configured to follow the perimeters of the front edge 46 of the freezer liner 32 as well as the perimeters of the inner lower coupling portion 66 of the thermal bridge 10 for properly positioning the surround lighting feature 120 within the freezer compartment 44. Thus, the surround lighting features are disposed around the openings 31, 47 of the compartments 28, 44, respectively.

As further shown in FIG. 2, the vacuum insulated cabinet structure 2 further includes the exterior wrapper 8 which includes a top wall 50, a bottom wall 52, opposed sidewalls 54, 56, and a rear wall 58 which cooperate to define a cavity 59. The wrapper 8 further includes a front edge 60 which is disposed along an opening 61 of the cavity 59 which is further disposed along the top wall 50, bottom wall 52 and opposed sidewalls 54, 56 so as to be a circumventing frontmost edge 60 of the exterior wrapper 8 presented in a quadrilateral ring configuration. In assembly, the front edge 60 of the exterior wrapper 8 is coupled to coupling portions of the thermal bridge 10 around the liners 16, 32. In this way, the thermal bridge 10 interconnects the exterior wrapper 8 and the refrigerator liner 16 and the freezer liner 32 when assembled. Further, the refrigerator liner 16 and freezer liner 32 are received within the cavity 59 of the exterior wrapper 8 when assembled, such that there is a spacing between the outer surfaces of the refrigerator liner 16 and the freezer liner 32 relative to the inner surfaces of the exterior wrapper 8. In this way, the spacing can be used to create a vacuum insulated space as further described below.

The wrapper 8 may be made from sheet metal, polymer materials, or other suitable materials. If the wrapper 8 is made from sheet metal, the wrapper 8 may be formed utilizing known steel forming tools and processes. Alternatively, the wrapper 8 may be formed from a polymer material. For example, the wrapper 8 may be fabricated by thermoforming a sheet of thermoplastic polymer material. The wrapper 8 may be constructed of a material that is substantially impervious, such that oxygen, nitrogen, carbon dioxide, water vapor, and/or other atmospheric gasses are sealed out of the vacuum cavity VC (FIG. 3) defined in the spacing or gap that is formed between the wrapper 8 and liners 16, 32 as discussed in more detail below. If the wrapper 8 is formed from a polymer material, the polymer material may comprise a plurality of layers, wherein the layers of material are selected to provide impermeability to gasses.

The refrigerator liner 16 and the freezer liner 32 are preferably made from a sheet metal material utilizing known steel forming tools and processes. The liners 16, 32 may otherwise be formed from a polymer material in the form of a polymer sheet that is thermoformed. The polymer material may comprise one or more layers of material that are selected to provide impermeability to gasses. The liners 16, 32 may optionally include a plurality of reinforcing structures, such as vertically spaced ridges or other forms for supporting dividers within the refrigerator compartment 28 or freezer compartment 44. Examples of layered polymer materials that may be utilized to construct the wrapper 8 or liners 16, 32 are disclosed in U.S. patent application Ser. No. 14/980,702, entitled "MULTILAYER BARRIER MATERI- ALS WITH PVD OR PLASMA COATING FOR VACUUM INSULATED STRUCTURE," and U.S. patent application Ser. No. 14/980,778, entitled "MULTI-LAYER GAS BARRIER MATERIALS FOR VACUUM INSULATED STRUCTURE," filed on Dec. 28, 2015, the entire contents of which are incorporated by reference. Specifically, the wrapper 8 and/or liners 16, 32 may be thermoformed from a tri-layer sheet of polymer material comprising first and second outer structure layers and a central barrier layer that is disposed between the outer layers. The outer layers and the barrier layer may comprise thermoplastic polymers. The barrier layer may optionally comprise an elastomeric material. The outer layers and the barrier layer may be coextruded or laminated together to form a single multi-layer sheet prior to thermoforming. The outer layers or walls of the wrapper 8 and liners 16, 32 are contemplated to have a thickness of about 0.1 mm to 10 mm, and the barrier layer(s) are contemplated to have a thickness of about 0.1 mm to 10 mm. For purposes of this disclosure, the wrapper 8 and liners 16, 32 are contemplated to be metal components that hold a vacuum therebetween as interconnected by the thermal bridge 10.

As shown in FIG. 2, the front edge 30 of the refrigerator liner 16 includes linear portions disposed around the top wall 18, bottom wall 20 and opposed sidewalls 22, 24 at front portions thereof, such that front edge 30 of the refrigerator liner 16 is generally quadrilateral. As further shown in FIG. 2, the front edge 46 of the freezer liner 32 includes linear portions disposed around the top wall 34, bottom wall 36 and opposed sidewalls 38, 40 at front portions thereof, such that front edge 46 of the freezer liner 32 is also generally quadrilateral. As depicted in FIG. 2 and further shown in FIG. 3, the profile of the combination of the liners 16, 32 is preferably somewhat smaller than the profile of the wrapper 8 to thereby form the vacuum cavity VC (FIG. 3) within the spacing defined between the liners 16, 32 and the wrapper 8 when the liners 16, 32 are positioned inside the cavity 59 of the wrapper 8. The vacuum cavity VC is configured to receive an insulating material (not shown) that may be described as a vacuum core material. The vacuum core material may comprise a plurality of preformed individual core panels that are preformed and positioned between wrapper 8 and the liners 16, 32 during assembly prior to the connection of the thermal bridge 10 to portions of the wrapper 8 and the liners 16, 32. Alternatively, the vacuum core material may comprise silica powder or other suitable loose filler material that is inserted (e.g. blown) into the vacuum cavity VC after wrapper 8, liners 16, 32, and thermal bridge 10 are coupled together as a unitary composite structure. Once the wrapper 8, liners 16, 32, and thermal bridge 10 are coupled together in an airtight manner, a vacuum is drawn in the vacuum cavity VC (FIG. 3) to provide a vacuum insulated structure 2.

Figure 5:
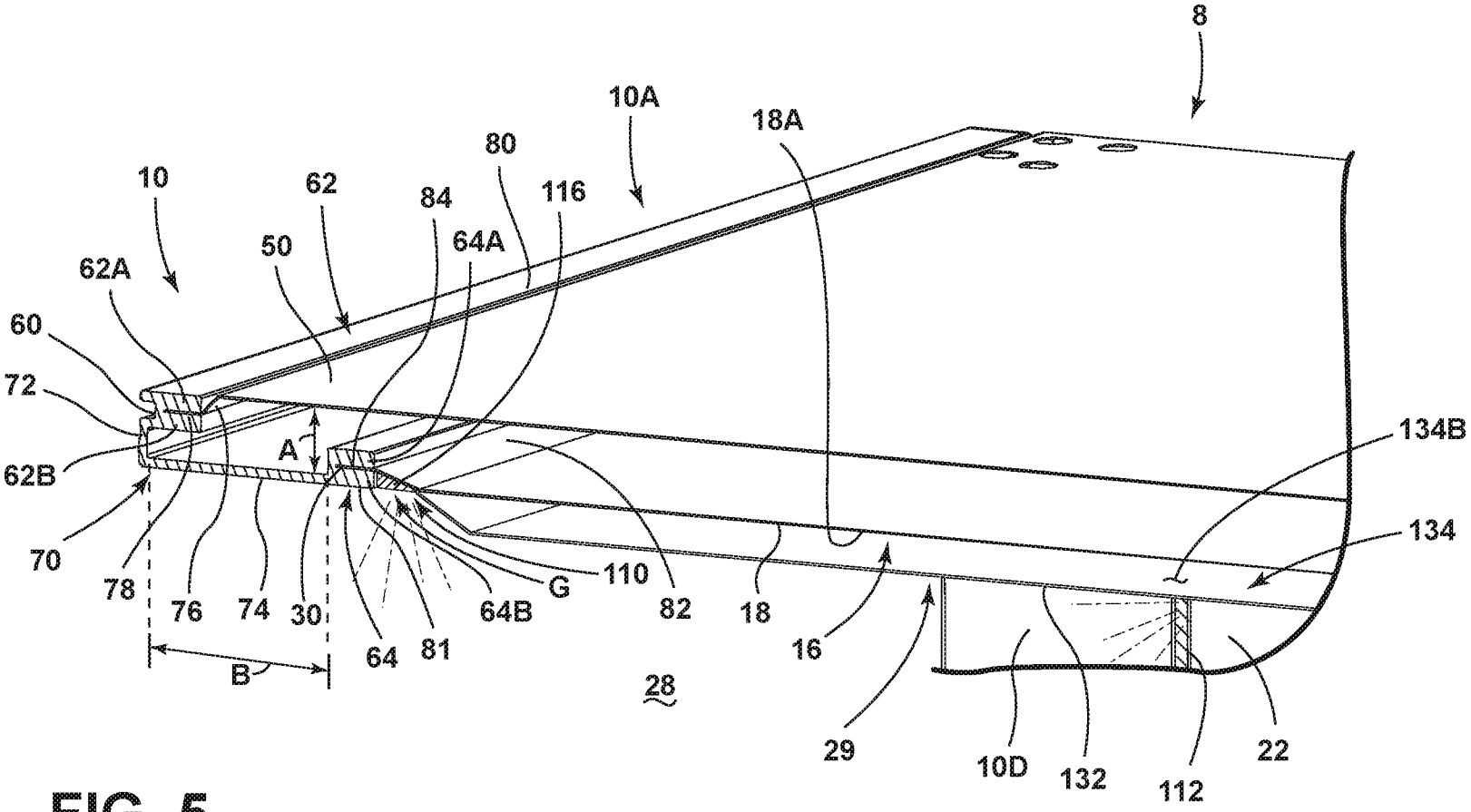
FIG. 5 is a fragmentary isometric cross-sectional view of the vacuum insulated cabinet structure of FIG. 4 taken at location V.
Figure 7:
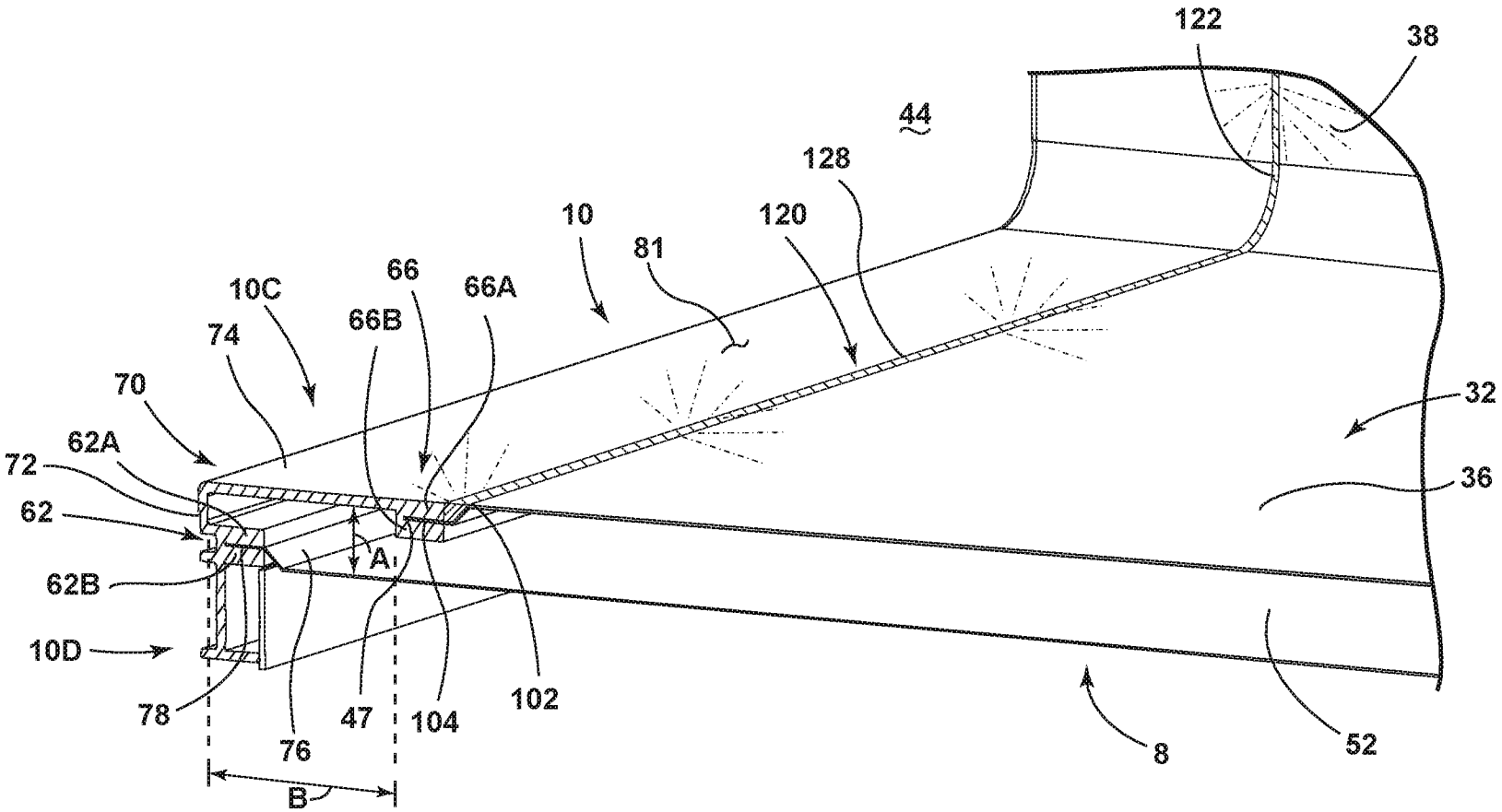
FIG. 7 is fragmentary cross-sectional view of the vacuum insulated cabinet structure of FIG. 4 taken at location VII.

As configured in assembly, the front edges 30, 46 of the liners 16, 32 are spaced-apart from each other at the linear portion disposed along the bottom wall 20 of the refrigerator liner 16 and the linear portion disposed along the top wall 34 of the freezer liner 32. Further, the front edges 30, 46 of the liners 16, 32 disposed along the opposed sidewalls 22, 24 and 38, 40 of the liners 16, 32, and the top wall 18 of the refrigerator liner 16 and the bottom wall 36 of the freezer liner 32 are spaced-apart from the linear portions defining the front edge 60 of the wrapper 8 in assembly as best shown in FIGS. 4, 5 and 7.

Figure 3:
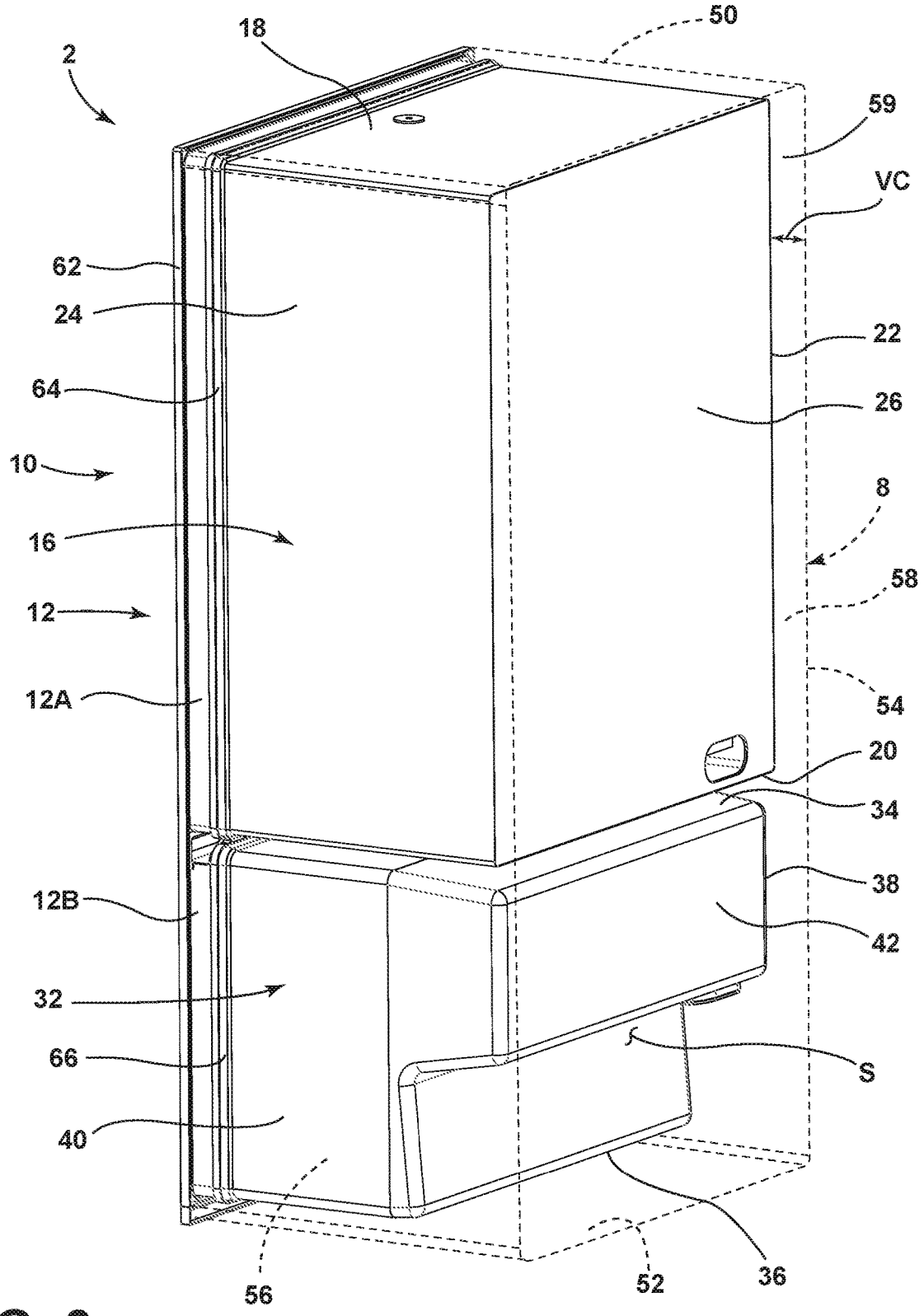
FIG. 3 is a rear isometric view of the vacuum insulated cabinet structure of FIG. 2 as shown in an assembled condition.

When the vacuum insulated cabinet structure 2 is assembled, as shown in FIG. 3, the thermal bridge 10 connects to the front edge 60 of the wrapper 8, to the front edge 30 of the refrigerator liner 16, and to the front edge 46 of the freezer liner 32 to thereby interconnect the wrapper 8 and the liners 16, 32 into a unitary structure. The thermal bridge 10 may be formed from a suitable material that is substantially impervious to gasses to maintain a vacuum in the vacuum cavity VC, and also having a low coefficient of thermal conductivity to reduce or prevent transfer of heat between the wrapper 8 and the liners 16, 32. For use with the present concept, the thermal bridge 10 is preferably formed utilizing a molding process, and specifically, may include a reaction injection molding (RIM) process. In an RIM process, the thermal bridge 10 is likely formed in a mold using a polyurethane material. Other materials suitable for an RIM process may include, but are not limited to, polyureas, polyisocyanurates, polyesters, polyphenols, polyepoxides, thermoplastic elastomers, polycarbonate, and nylon materials. Using an RIM process of the present concept, the thermal bridge 10 can be overmolded to the refrigerator liner 16, the freezer liner 32 and wrapper 8 at the front edges 30, 46, 60, respectively, thereof. In this way, the vacuum insulated cabinet structure 2 can be a unitary part after the thermal bridge 10 is cast onto the front edges 30, 46, 60, of the liners 16, 32 and the wrapper 8.

When refrigerator 1 (FIG. 1) is in use, the wrapper 8 is typically exposed to ambient room temperature air, whereas the liners 16, 32 are generally exposed to refrigerated air in the refrigerator compartment 28 or the freezer compartment 44. With the thermal bridge 10 being made of a material that is substantially non-conductive with respect to heat, the thermal bridge 10 reduces transfer of heat from the wrapper 8 to the liners 16, 32.

Thermal bridge 10 may include linear portions that are interconnected to form a ring-like structure having a quadrilateral perimeter or outer coupling portion 62 and upper and lower quadrilateral inner coupling portions 64, 66. The upper and lower inner coupling portions 64, 66 define upper and lower openings 12A, 12B that generally correspond to the openings 31, 47 defined by the front edges 30, 46 of the refrigerator liner 16, and freezer liner 32 of the cabinet structure 2. In assembly, the outer coupling portion 62 is coupled to the front edge 60 of the wrapper 8. Further, the inner coupling portions 64, 66 are disposed inside of the outer coupling portion 62 and set back therefrom, as further described below. In assembly, the upper and lower inner coupling portions 64, 66 are coupled to the front edges 30, 46 of the refrigerator liner 16, and freezer liner 32, respectively. It will be understood that the thermal bridge 10 may have various shapes and configurations as may be required for a particular application, and it is further contemplated that the thermal bridge 10 can be used in a refrigerator having multiple liners (as shown in FIG. 2 with a refrigerator liner and a freezer liner) or in a refrigerator having a single liner for use as a refrigerator or freezer only appliance.

Referring now to FIG. 4, the refrigerator 1 is shown in a cross-sectional view having the refrigerator liner 16 and freezer liner 32 coupled to the thermal bridge 10 at upper and lower openings 12A, 12B, respectively. Further, the wrapper 8 is also coupled to the thermal bridge 10, such that the thermal bridge 10 interconnects the wrapper 8 with the refrigerator liner 16 and freezer liner 32 in an air tight sealed manner, such that a vacuum can be drawn in the vacuum cavity VC disposed therebetween. In one embodiment, the thermal bridge 10 of the present concept can be overmolded to the liners 16, 32 and wrapper 8 to hermetically seal the components together as a unitary whole as shown in FIG. 3. As used herein, the term "overmolded" and/or "overmolding" refers to a process by which one thermoplastic material is molded over another material(s) to form a unitary part. In another embodiment, the thermal bridge 10 is coupled to the wrapper 8, refrigerator liner 16, and freezer liner 32 using a curable sealant at upper and lower inner coupling portions 64, 66 and outer coupling portion 62.

As further shown in FIG. 4, the wall covering assembly 29 includes a substantially upright rear wall 130 which is disposed adjacent to, yet spaced-apart from, rear wall 26 of the refrigerator liner 16. The wall covering assembly 29 further includes a top wall 132 which is disposed adjacent to and spaced-apart from the top wall 18 of the refrigerator liner 16. In this way, the wall covering assembly 29 forms a cavity 134 extending along the upper and rear portions of the refrigerator compartment 28. Specifically, the cavity 134 includes a first portion 134A disposed along the rear wall 26 of the refrigerator liner 16 and second portion 134B which extends along the top wall 18 of the refrigerator liner 16. The first and second portions 134A, 134B of the cavity 134 are used to house a wiring system 140 having a first end 142 electrically coupled to the surround lighting feature 110 and a second end 144 electrically coupled to a power source 146. The wiring system 140 is concealed within the cavity 134 provided by the wall covering assembly 129 as disposed within the refrigerator compartment 128. As further shown in FIG. 4, the wall covering assembly 29 includes an inclined portion 148 for defining a housing area 150 in which cooling components 152 are housed for cooling the refrigerator compartment 28. Further, the power source 146 for the wiring system 140 is also contemplated to be disposed within the housing area 150 that is concealed by the wall covering assembly 29. In this way, the vacuum cabinet structure 2 can remain and sealed and under vacuum without the need for piercing the vacuum cabinet structure 2 to provide power to the surround lighting feature 110. Further, with the wall covering assembly 29 in place within the refrigerator compartment 28, the power supply 146 and wiring system 140 can remain concealed while powering the surround lighting feature 110 to provide a pleasing aesthetic for the surround lighting feature 110.

Referring now to FIG. 5, an upper portion 10A of the thermal bridge 10 is shown having the outer coupling portion 62 disposed above the upper inner coupling portion 64. The outer coupling portion 62 is interconnected with the upper inner coupling portion 64 by a central wall or web 70 having both an upright portion 72 and a horizontal portion 74. As shown in FIG. 5, the outer coupling portion 62 is coupled to the upright portion 72 of the central wall or web 70, such that the outer coupling portion 62 is raised above the upper inner coupling portion 64. Further, the upper inner coupling portion 64 is staggered or offset relative to the outer coupling portion 62. Specifically, in the embodiment shown in FIG. 5, the upper inner coupling portion 64 is disposed inward and below the outer coupling portion 62 as disposed on an end of the horizontal portion 74 of the central wall or web 70. As shown in FIG. 5, the front edge 60 of the wrapper 8 may include an angled transverse wall 76 and an end flange portion 78 that is received in the outer coupling portion 62 of the thermal bridge 10. The angle of the transverse portion 76 of the wrapper 8 allows the top wall 50 of the wrapper 8 to be flush with an outer surface 80 of the thermal bridge 10, when the end flange portion 78 is received in the outer coupling portion 62 of the thermal bridge 10. The end flange portion 78 is contemplated to be part of the front edge 60 of the wrapper 8 that is received in the outer coupling portion 62 thereof for providing a surface for attachment of the outer coupling portion 62 at upper and lower contact surfaces 62A, 62B thereof. Similarly, the refrigerator liner 16 includes an angled transverse portion 82 extending from top wall 18 thereof, and leading to an end flange portion 84 which is received in the upper inner coupling portion 64 of the thermal bridge 10. The angle of transverse portion 82 of the refrigerator liner 16 allows for the inner surface 18A of top wall 18 to align with an inner surface 81 of the thermal bridge 10. With the front edge 30 of the refrigerator liner 16 received in the inner upper coupling portion 64, the end flange portion 84 provides a surface for the thermal bridge 10 to adhere to the refrigerator liner 16 at contact surfaces 64A, 64B at upper inner coupling portion 64. Thus, the front edge 60 of the wrapper 8 is not only spaced-apart from the front edge 30 of the refrigerator liner 16 so as to be outside of the front edge 30 of the refrigerator liner 16 (as indicated by arrow A), but is also offset laterally outward from the front edge 30 of the refrigerator liner 16 (as indicated by arrow B). Similarly, the thermal bridge 10 includes a staggered configuration for outer coupling portion 62 relative to the upper inner coupling portion 64 for receiving the front edge 60 of the wrapper 8 and the front edge 30 of the refrigerator liner 16. This staggered configuration is also present between the wrapper 8 and the freezer liner 32, as further described below.

As further shown in FIG. 5, the transverse portion 82 of the refrigerator liner 16 provides for a gap G disposed between the inner surface 81 of the thermal bridge 10 and the top wall 18 of the refrigerator liner 16. The gap G has a specific contour, as further described below, and essentially defines a U-shaped outwardly opening channel. In FIG. 5, the upper portion 116 of the surround lighting feature 110 is disposed within the gap G. The upper portion 116 of the surround lighting feature 110 is contemplated to substantially fill the gap G between the thermal bridge 10 and the refrigerator liner 16 to provide a clean aesthetic for the refrigerator compartment 28, as further described below. As positioned within the gap G, the upper portion 116 of the surround lighting feature 110 is contemplated to emit a downwardly directed light as indicated in FIG. 5. As further shown in FIG. 5, the side portion 112 of the surround lighting feature 110 is disposed between sidewall 10D of the thermal bridge 10 and sidewall 22 of the refrigerator liner 22 and is configured to inwardly emit light into the refrigerator compartment 28 as indicated in FIG. 5.

Figure 6:
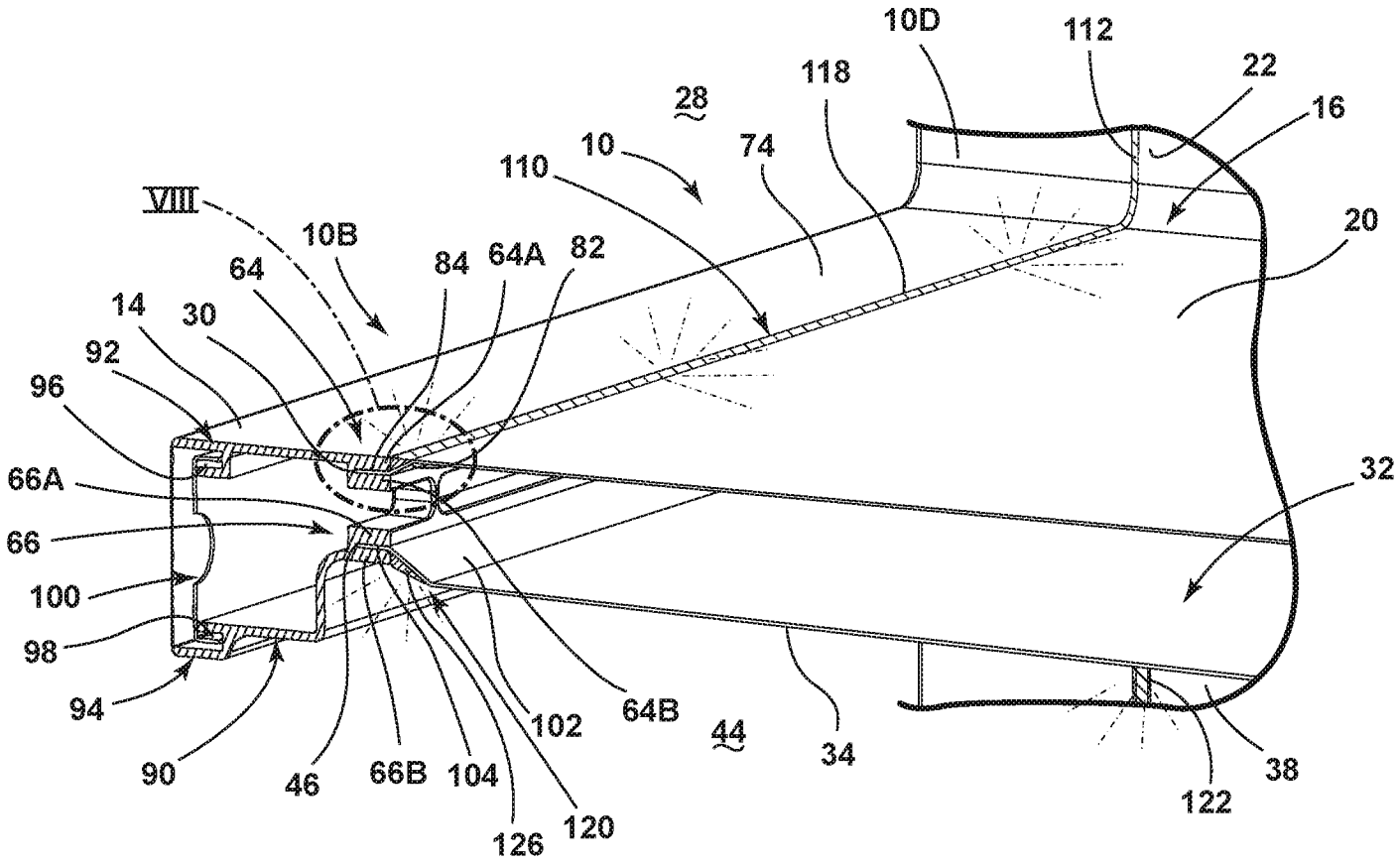
FIG. 6 is a fragmentary cross-sectional view of the vacuum insulated cabinet structure of FIG. 4 taken at location VI.

Referring now to FIG. 6, a middle portion 10B of the thermal bridge 10 is shown having inner upper coupling portion 64 disposed above lower inner coupling portion 66. The lower inner coupling portion 66 is interconnected with the upper inner coupling portion 64 by a central wall or web 90. The web 90 includes outwardly opening upper and lower channels 92, 94 that are configured to a receive attachment flanges 96, 98 of a trim member 100. It is contemplated that the thermal bridge 10 may also be over molded to the trim member 100 in assembly. As further shown in FIG. 6, the upper inner coupling portion 64 is disposed above the lower inner coupling portion 66. Further, the upper inner coupling portion 64 is not staggered or offset relative to the lower inner coupling portion 66, but rather they are aligned with one another. In the embodiment shown in FIG. 6, the refrigerator liner 16 includes the transverse portion 82 extending off of bottom wall 20 thereof, and leading to the end flange portion 84 which is received in the upper inner coupling portion 64. Thus, the transverse portion 82 of the refrigerator liner 16 is disposed all the way around the opening 31 of the refrigerator liner 16 at top wall 18, bottom wall 20 and opposed side walls 22, 24 at front portions thereof. The end flange portion 84 is also disposed fully around the refrigerator liner 16 extending outwardly from transverse portion 82, and defining a surface for adhering engagement with contact surfaces 64A, 64B of the upper inner coupling portion 64 of the thermal bridge 10.

Similarly, the freezer liner 32 includes a transverse portion 102 extending off of top wall 34 thereof, and leading to an end flange portion 104 which is received in the lower inner coupling portion 66. Like the refrigerator liner, the transverse portion 102 of the freezer liner 32 is disposed all the way around the opening 47 of the freezer liner 32 at top wall 34, bottom wall 36 and opposed side walls 38, 40 at front portions thereof. The end flange portion 104 is also disposed fully around the freezer liner 32 extending outwardly from transverse portion 102, and defining a surface for adhering engagement with upper and lower contact surfaces 66A, 66B of the upper inner coupling portion 64 of the thermal bridge 10 which are overmolded to the end flange portion 104.

As further shown in FIG. 6, the lower portion 118 and side portion 112 of the surround lighting feature 110 is shown disposed within the refrigerator compartment 28 between the thermal bridge 10 and the refrigerator liner 16. As further shown in FIG. 6, the surround lighting feature 120 is shown disposed within the freezer compartment 44 between the thermal bridge 10 and the freezer liner 32. The upper portion 126 and side portion 122 of the surround lighting feature 120 are shown emitting light inwardly into the freezer compartment 44 in FIG. 6.

Referring now to FIG. 7, a lower portion 10C of the thermal bridge 10 is shown having the outer coupling portion 62 disposed below the lower inner coupling portion 66. The outer coupling portion 62 is interconnected with the lower inner coupling portion 66 by the central wall or web 70 having the upright portion 72 and the horizontal portion 74. As shown in FIG. 7, the outer coupling portion 62 is raised above the lower inner coupling portion 66. Further, the lower inner coupling portion 66 is staggered or offset relative to the outer coupling portion 62. Specifically, in the embodiment shown in FIG. 7, the lower inner coupling portion 66 is disposed inward and below the outer coupling portion 62 as disposed on an end of the horizontal portion 74 of the central wall or web 70. Thus, the staggered configuration of the outer coupling portion 62 and the lower inner coupling portion 66 is akin to the staggered configuration of the outer coupling portion 62 and the upper inner coupling portion 64 shown in FIG. 5. As further shown in FIG. 7, the angle of the transverse portion 102 of the freezer liner 32 allows the bottom wall 36 of the freezer liner 32 to be flush with an inner surface 81 of the thermal bridge 10, when the end flange portion 104 is received in the lower inner coupling portion 66 of the thermal bridge 10. Thus, the front edge 60 of the wrapper 8 is not only spaced-apart from the front edge 46 of the freezer liner 32 so as to be outside of the front edge 46 of the freezer liner 32 (as indicated by arrow A), but is also offset laterally outward from the front edge 46 of the freezer liner 32 (as indicated by arrow B). Similarly, the thermal bridge 10 includes a staggered configuration for outer coupling portion 62 relative to the lower inner coupling portion 66 for receiving the front edge 60 of the wrapper 8 and the front edge 46 of the freezer liner 32. In assembly, it is contemplated that the outer coupling portion 62 of the thermal bridge 10 is disposed outwardly (as indicated by arrow A shown in FIG. 5 and arrow A shown in FIG. 7) relative to the upper inner coupling portion 64 (FIG. 5) and the lower inner coupling portion 66 (FIG. 7). Further, the outer coupling portion 62 of the thermal bridge 10 is also offset in a laterally outward direction relative to the upper inner coupling portion 64 (FIG. 5) and the lower inner coupling portion 66 (FIG. 7) as indicated by arrow B in FIG. 5 and arrow B in FIG. 7.

As further shown in FIG. 7, surround lighting feature 120 is shown having lower portion 128 and side portion 122 disposed between the thermal bridge 10 and the freezer liner 32 with light emitting inwardly therefrom into the freezer compartment 44 for illuminating the same.

Thus, as shown in FIGS. 5-7, the end flange portions 78, 84 and 104 of the wrapper 8, refrigerator liner 16, and freezer liner 32, respectively, include first and second outer contact surfaces on opposed sides thereof. These opposed contact surfaces of the end flange portions 78, 84 and 104 are enrobed or covered by a resin material used to form the contact surfaces 62A, 62B; 64A, 64B; and 66A, 66B of the thermal bridge 10 to adhere the thermal bridge 10 to the wrapper 8, refrigerator liner 16, and freezer liner 32, as further described below.

Figure 8:
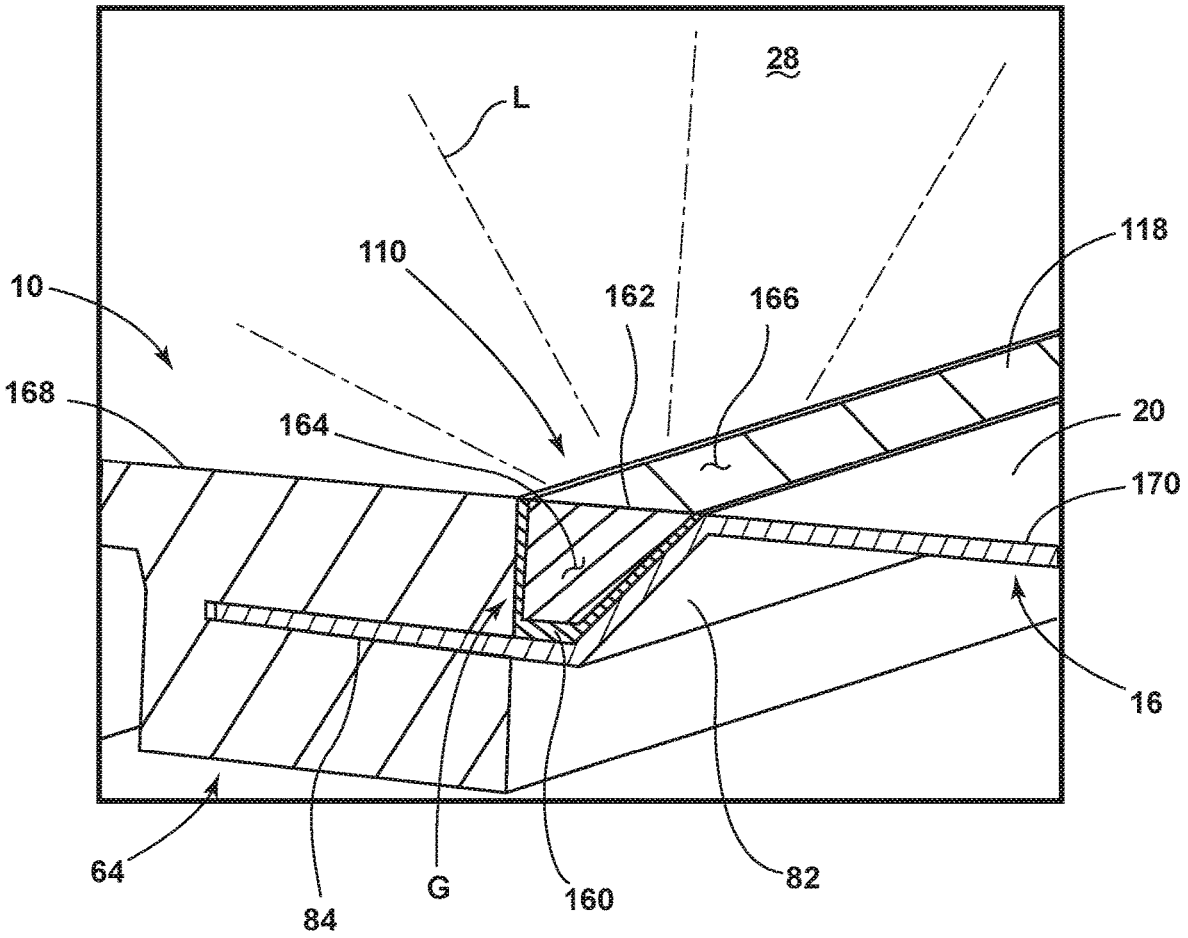
FIG. 8 is a close up cross-sectional view of the vacuum insulated cabinet structure of FIG. 6 taken at location VIII.

Referring now to FIG. 8, the surround lighting feature 110 is shown having the lower portion 118 thereof disposed within the gap G between the thermal bridge 10 and the refrigerator liner 16. The gap G is a contoured gap that is partially defined by the thermal bridge 10 and partially defined by the refrigerator liner 16. Specifically, the front coupling portion 84 and transverse portion 82 of bottom wall 20 of the refrigerator liner 16 is shown in FIG. 8 to provide lower and side portions of the contoured gap G, while upper inner coupling portion 64 of the thermal bridge 10 provides a second side portion of the contoured gap G. In this way, the contoured gap G defines an upwardly opening U-shaped channel in which the surround lighting feature 110 is received in assembly. The contoured gap G is contemplated to entirely surround the connection between the thermal bridge 10 and the refrigerator liner 16, such that the surround lighting feature 110 is disposed within the contoured gap G around the interior of the refrigerator compartment 28. The surround lighting feature 110 includes an attachment portion 160 which is shown in FIG. 8 as substantially conforming to the contours of the contoured gap G for coupling to the refrigerator liner 16 and the thermal bridge 10. It is contemplated that the coupling portion 160 may be coupled to both the thermal bridge 10 and the refrigerator liner 16, or may be coupled to one or the other in assembly. The surround lighting feature 110 further includes an outer layer 162, which together with the coupling portion 160, defines an inner cavity 164. The outer layer 162 is contemplated to be a transparent or translucent layer from which light L can be emitted inwardly therefrom. Thus, as disposed around the refrigerator compartment 28, the surround lighting feature 110 inwardly emits light L therefrom to illuminate the refrigerator compartment 28 in a surround configuration. In the embodiment shown in FIG. 8, the outer layer 162 includes an outer surface 166 which aligns with an outer surface 168 of the thermal bridge 10 as well as an outer surface 170 of the refrigerator liner 16. In FIG. 8, the outer surface 168 of the thermal bridge 10 and the outer surface 170 of the refrigerator liner 16 are substantially disposed in a same plane along with outer surface 166 of the surround lighting feature. In this way, the surround lighting feature 110 substantially fills the gap G between the thermal bridge 10 and the refrigerator liner 16 to provide a continuous surface between outer surface 170 of the refrigerator liner 16 and outer surface 168 of the thermal bridge 10 via outer surface 166 of outer layer 162 of the surround lighting feature 110. By substantially filling the contoured gap G between the thermal bridge 10 and refrigerator liner 16, a user of the present concept can easily clean the refrigerator compartment 28 by wiping across the walls of the refrigerator compartment 28 over the surround lighting feature 110 and over the thermal bridge 10. As specifically shown in FIG. 8, a user can wipe from the refrigerator compartment 28 at bottom wall 20 along outer surface 170 thereof across the outer surface 166 of the surround lighting feature 110 and over the outer surface 168 of the thermal bridge 10 to remove liquid and debris from the refrigerator compartment 28. Thus, the surround lighting feature 110 not only illuminates the refrigerator compartment 28, but also provides a gap filling feature for facilitating the cleaning of the refrigerator compartment 28.

The surround lighting features 110, 120 are contemplated to be light strips or light guides which are configured within the refrigerator compartment 28 and freezer compartment 44 in a manner so as to inwardly emit light into the respective compartments. The surround lighting features 110, 120 are contemplated to be any form of a light guide that is known including light strips which are powered by light emitting diodes (LEDs) which propagate light along the length of the lighting feature and emit light through the outer surface thereof. LEDs may be dispersed along the length of either lighting feature 110, 120 in a random or controlled manner as to sufficiently light the compartment in which the lighting feature 110, 120 is disposed. The inner cavity 164 of the surround light feature 100 (FIG. 8) is contemplated to include a light transmissive material, or may be a hollow cavity having reflective portions for propagating light along the entirety of the body portion of the surround light feature 110.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only.

Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A refrigerator, comprising:

a vacuum insulated cabinet having a liner disposed within a wrapper, wherein the liner and wrapper are interconnected by a thermal bridge to form a vacuum cavity therebetween, and further wherein the liner includes an outer surface aligned with an outer surface of the thermal bridge;

a wall covering assembly having a top wall disposed adjacent to and spaced-apart from a top wall of the liner and a rear wall disposed adjacent to and spaced-apart from a rear wall of the liner, wherein the liner and the wall covering assembly cooperate to define a refrigerator compartment;

a cavity formed between the liner and the wall covering assembly; and a lighting assembly disposed around an opening into the refrigerator compartment, wherein the lighting assembly is powered by a wiring system concealed by the wall covering assembly, wherein the lighting assembly includes an outer layer through which light is emitted into the refrigerator compartment, and further wherein the outer layer includes an outer surface aligned with the outer surface of the thermal bridge and the outer surface of the liner.

2. The refrigerator of claim 1, wherein the cavity includes a first portion disposed between the rear wall of the liner and the rear wall of the wall covering assembly, and a second portion disposed between the top wall of the liner and the top wall of the wall covering assembly.

3. The refrigerator of claim 1, wherein the wiring system includes a first end coupled to the lighting assembly, and a second end coupled to a power source disposed behind the wall covering assembly.

4. The refrigerator of claim 1, wherein the vacuum insulated cabinet includes a gap disposed between portions of the liner and the thermal bridge along a front portion of the refrigerator compartment.

5. The refrigerator of claim 4, wherein the lighting assembly is disposed in the gap between the liner and thermal bridge.

6. The refrigerator of claim 1, wherein the lighting assembly includes a light guide having a body portion coupled to the refrigerator compartment.

7. A refrigerator, comprising:

a liner having a plurality of walls defining a compartment, and a front edge defining an opening into the compartment, wherein the liner further includes a transverse portion that is inwardly angled and positioned between the compartment and the front edge of the liner;

a thermal bridge having a coupling portion coupled to the front edge of the refrigerator liner;

an outwardly opening channel disposed between the transverse portion of the liner and the coupling portion of the thermal bridge; and a lighting assembly received in the outwardly opening channel, wherein the lighting assembly is substantially disposed around an entirety of the opening into the compartment.

8. The refrigerator of claim 7, wherein the lighting assembly includes a light guide having a body portion coupled to the compartment.

9. The refrigerator of claim 7, wherein the liner includes an outer surface aligned with an outer surface of the thermal bridge.

10. The refrigerator of claim 9, wherein the lighting assembly includes an outer surface aligned with the outer surface of the thermal bridge and the outer surface of the liner.

11. The refrigerator of claim 10, wherein the outer surface of the lighting assembly is disposed on an outer layer through which light is emitted into the compartment.

12. The refrigerator of claim 7, including:

a wall covering assembly disposed within the compartment; and a power source electrically coupled to the lighting assembly and concealed by the wall covering assembly.

13. The refrigerator of claim 7, including:

one or more doors operable between open and closed positions relative to the compartment, wherein the lighting assembly illuminates the compartment when one of the one or more doors is in the open position.

14. A refrigerator, comprising:

a refrigerator liner having a quadrilateral front edge and an outer surface;

a thermal bridge having an outer surface and a coupling portion coupled to the front edge of the refrigerator liner, wherein a channel is formed between the outer surface of the refrigerator liner and the outer surface of the thermal bridge, and further wherein the outer surface of the refrigerator liner is aligned with the outer surface of the thermal bridge; and a lighting assembly received in the channel, wherein the lighting assembly is substantially disposed around an opening into a refrigerator compartment defined by the refrigerator liner, and further wherein the lighting assembly includes an outer surface disposed in a same plane as the outer surface of the thermal bridge and the outer surface of the liner.

15. The refrigerator of claim 14, wherein the lighting assembly includes first and second side portions interconnecting upper and lower portions, and further wherein the refrigerator liner includes first and second sidewalls interconnecting top and bottom walls, wherein the lighting assembly first and second side portions of the lighting assembly are disposed along the first and second sidewalls of the refrigerator liner, respectively, and further wherein the upper and lower portions of the lighting assembly are disposed along the top and bottom walls of the refrigerator liner.

16. The refrigerator of claim 14, wherein the lighting assembly includes a light guide.

* * * * *